United States Patent [19]

Hess, Jr.

[11] Patent Number: 4,660,745

[45] Date of Patent: Apr. 28, 1987

[54] SPRAY ACTUATOR

[76] Inventor: Lawrence Hess, Jr., 11922 Lower Colfax Rd., Grass Valley, Calif. 95945

[21] Appl. No.: 792,324

[22] Filed: Oct. 28, 1985

[51] Int. Cl.[4] ..... B67D 5/64

[52] U.S. Cl. ..... 222/174; 222/402.15; 248/312

[58] Field of Search ..... 222/174, 323, 402.15, 222/472–474, 191; 239/532; 248/312, 316.5; 269/2, 238, 254 CS; 24/514, 522, 573, 580

[56] References Cited

U.S. PATENT DOCUMENTS

| | | | |
|---|---|---|---|
| 2,820,578 | 1/1958 | Dickman | 222/323 |
| 3,229,859 | 1/1966 | Conroy et al. | 222/402.15 X |
| 3,398,919 | 8/1968 | Tokar | 248/316.5 X |
| 3,856,209 | 12/1974 | Hickson | 222/174 X |
| 3,861,566 | 1/1975 | Wentzell | 222/174 |
| 4,089,440 | 5/1978 | Lee | 222/174 |
| 4,092,000 | 5/1978 | Offutt, III | 239/532 |

FOREIGN PATENT DOCUMENTS

| | | | |
|---|---|---|---|
| 1475954 | 2/1967 | France | 248/316.5 |

*Primary Examiner*—Joseph J. Rolla
*Assistant Examiner*—Michael S. Huppert
*Attorney, Agent, or Firm*—Harvey B. Jacobson

[57] ABSTRACT

A remote actuator for an aerosol can is in the form of an elongate rod having a jaw structure at one end for gripping around the neck of the can, a pivoted finger above the jaw structure for depressing the spray-release button of the can, an operating handle for the pivoted finger located adjacent the other end of the rod, and a linkage extending through the rod interior connecting the finger and the handle. Alternative jaw structures are described and the actuator may have a squeegie device for attachment to the other end of the rod to extend its uses.

3 Claims, 6 Drawing Figures

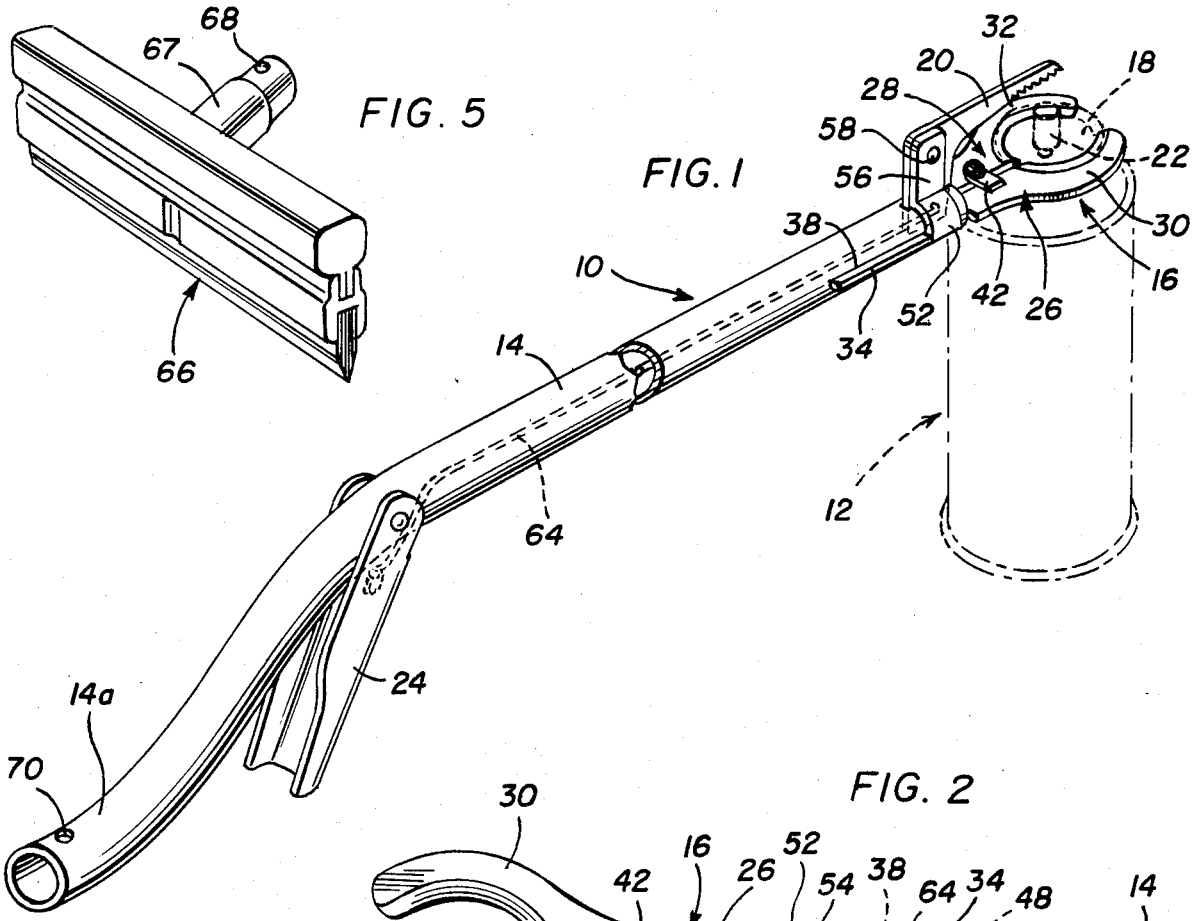
FIG. 5
FIG. 1
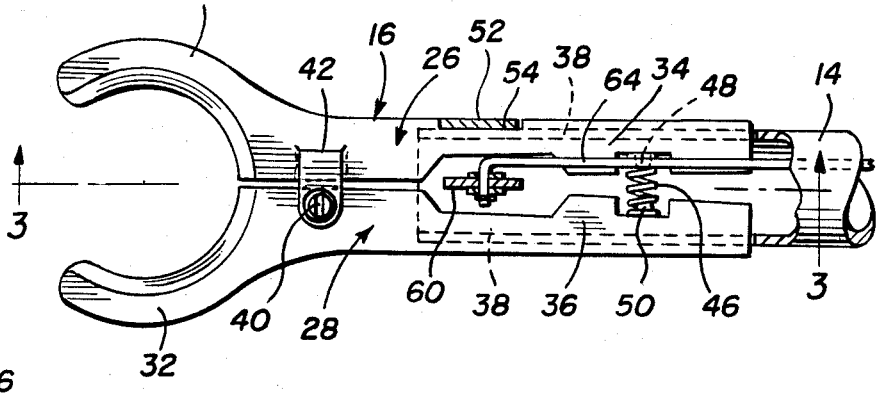
FIG. 2
FIG. 4
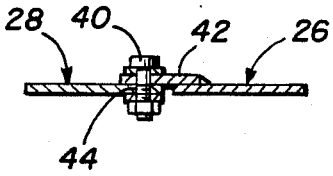
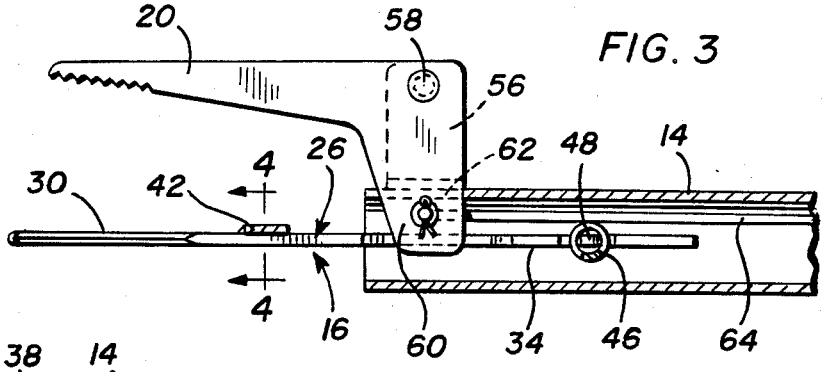
FIG. 3
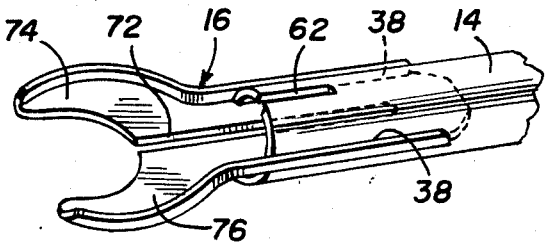
FIG. 6

SPRAY ACTUATOR

BACKGROUND OF THE INVENTION

This invention relates to apparatus for providing remote actuation of an aerosol spray can and the like.

There are frequent occurrences when a user needs to spray liquid from an aerosol can to an out-of-reach location making it necessary, for example, for the user to stand on a ladder or platform in order to reach the required point of application of the spray.

It is accordingly an object of the present invention to provide a remote operating attachment for an aerosol can which effectively extends the user's reach allowing the user to spray into locations not normally accessible.

SUMMARY OF THE INVENTION

The invention provides a remote actuator for an aerosol can comprising an elongate rod, preferably about 40 inches in length, having a jaw structure at one end for gripping around the neck of an aerosol can, a pivoted actuating finger above the jaw structure for depressing a spray release button of the can, and an actuating linkage extending from the finger along the rod to an actuating handle at the other end of the rod. A removable squeegee-type attachment may be provided for the other end of the rod for cleaning windows and the like.

In one preferred form of the invention, for example, the rod may be of tubular form, at least at said one end, and the jaw structure may include pivotally interconnected spring-loaded jaw members with tail portions located in an elongate slit in the rod, a spring being connected between the tail portions of the jaw members internally of the rod for urging jaw portions thereof toward one another, the outer edge of the tail portion of at least the movable jaw member being exposed on one side of the rod for exerting pressure thereon for opening the jaws, the fixed jaw member being connected to the rod by means of a collar having an upward extension forming a pivot connection for the actuating finger, and the actuating finger having a lever portion extending through a further slit in the rod for connection to said linkage internally of the rod.

In another preferred form of the invention, the jaw structure may comprise a plate-type member of sheet material slit longitudinally to provide opposed resilient jaw portions which may be resiliently snapped onto and off of the neck of an aerosol can.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a perspective view of an aerosol can actuator in accordance with the invention in combination with an aerosol can which is shown in phantom.

FIG. 2 is an enlarged plan view part broken away of a forward end portion of the actuator.

FIG. 3 is a sectional view on line 3—3 of FIG. 2.

FIG. 4 is a sectional view on line 4—4 of FIG. 3.

FIG. 5 is a perspective view of a squeegee attachment for use with the actuator.

FIG. 6 is a perspective view of a modified jaw structure for the actuator.

DESCRIPTION OF THE PREFERRED EMBODIMENT

Referring initially to FIG. 1, there is shown a remote actuator 10 in combination with an aerosol can 12, the actuator including an elongate tubular rod 14 which may be about 40 inches in length, a jaw structure 16 at one end of the rod for gripping around the neck 18 of can 12, a pivotal finger 20 above the jaw structure for depressing the spray release button 22 of the can, and an operating handle 24 pivotally connected to the rod adjacent its other end for operating finger 20 through a linkage to be described, which extends through the interior of the rod. The actuator is simple to attach and detach from an aerosol can and is useful in extending a user's reach so as to enable spraying in otherwise inaccessible locations.

In greater detail, the jaw structure 16 comprises a fixed jaw member 26, and a movable jaw member 28. The jaw members have respective jaw portions 30, 32 shaped to fit the neck of the aerosol can, and respective elongate tail portions 34, 36 which fit in elongate slits 38 formed in the forward end of the rod 14. The jaw members are pivotally interconnected externally of rod 14 by a pivot pin 40 extending through a lug 42 secured to fixed jaw member 26 and through a hole 44 in a movable jaw member 28. A coil spring 46 is connected between lugs 48, 50 on the respective jaws internally of rod 14 for urging the jaw portions 30, 32 toward one another, and the outer edges of the respective jaw members protrude on opposite sides of the rod to allow the jaws to be moved apart by finger pressure against the spring action. The jaw structure is held on the rod by means of a collar 52 fixed in a groove 54 in the outer edge of jaw member 26, and secured around the outside of the rod as by welding.

Collar 52 has an upward extension 56 to which finger 20 is pivotally connected by a pivot pin 58, and the finger has a lever portion 60 extending through a further slit 62 in rod 14. Lever portion 60 is connected to handle 24 by means of a cord, wire, or the like 64 so that pulling on the handle causes the finger to depress aerosol button 22 and when the handle is released the sprung button lifts the finger.

FIG. 5 shows at squeegee attachment 66 which may be releaseably secured to end **14*a* of rod 14 with a spring detent 68 in a stem portion 67 of the attachment engaging a hole 70 in the rod end, so as to extend the uses of the actuator. FIG. 6 shows an alternative form of jaw structure 16' which may be used in place of structure 16. Jaw structure 16' comprises a plate of suitable metal or like sheet material divided by a longitudinal slit 72 into opposed jaw members 74, 76 which can be resiliently snapped onto and off of the neck 18** of the aerosol can.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A remote actuator for an aerosol can comprising an elongate rod, a jaw structure at one end of the rod for releasable clamping around the neck of an aerosol can, a pivoted finger on the rod above the jaw structure for depressing a spray-release button of the can, an operating handle for the pivoted finger adjacent the other end of the rod, linkage means extending along the rod connecting the finger and handle, said rod being of tubular form, the jaw structure comprising a fixed jaw member and a movable jaw member, each of said jaw members having a tail portion and a jaw portion, the respective tail portions being received in respective elongate slits formed in said one end of the rod, the respective jaw portions projecting from said one end of the rod and being interconnected by a pivot assembly, the jaw structure further including a spring means connected between the respective tail portions internally of the rod for urging the jaw portions toward one another, and at least the movable jaw member having an outer edge protruding from one side of the rod for applying finger pressure to the movable jaw for opening the jaw portions against the force of the spring means.

2. The invention of claim 1 including a collar extending around the outside of the rod connecting the fixed jaw member to the rod, the collar having an upward extension providing a pivot connection for said finger, and the finger having a lever portion extending from said pivot connection through a further slit in the rod, the linkage means connecting the lever portion of the finger with said handle and extending longitudinally through the interior of the rod.

3. The invention of claim 1 including a squeegee device including a stem portion for releasable telescopic engagement with the other end of the rod, said other end of said rod including a transverse hole, a spring biased detent on said stem portion of the squeegee device engaging said hole in the rod upon insertion of a stem portion of the squeegee device into said other end of the rod.

* * * * *